US006000849A

United States Patent [19]

Keller et al.

[11] Patent Number: 6,000,849

[45] Date of Patent: Dec. 14, 1999

[54] GIFT PACKAGE

[75] Inventors: Janet T. Keller, Eagan; Perry S. Dotterman, Maplewood; Karen F. MacDonald, St. Paul, all of Minn.

[73] Assignee: 3M Innovative Properties Company, Saint Paul, Minn.

[21] Appl. No.: 09/105,616

[22] Filed: Jun. 26, 1998

[51] Int. Cl.[6] ..... B65D 33/16

[52] U.S. Cl. ..... 383/80; 206/457; 229/125.12; 229/125.32; 383/78; 383/93

[58] Field of Search ..... 206/457; 383/78, 383/80, 81, 93, 95; 229/125.12, 125.32

[56] References Cited

U.S. PATENT DOCUMENTS

| | | | |
|---|---|---|---|
| D. 305,728 | 1/1990 | Tufariello | D9/305 |
| 2,136,338 | 11/1938 | Gulden | 229/125.12 |
| 2,721,023 | 10/1955 | Phipps | 229/62 |
| 3,268,151 | 8/1966 | Soto | 229/62 |
| 3,951,329 | 4/1976 | Turner | 229/125.32 |
| 4,059,222 | 11/1977 | Gamble | 383/95 |
| 4,216,900 | 8/1980 | Dederick | 229/55 |
| 4,323,187 | 4/1982 | Gillie | 229/125.32 |
| 4,657,176 | 4/1987 | Matsubara | 229/125.32 |
| 4,836,690 | 6/1989 | Cheng | 383/6 |
| 4,867,577 | 9/1989 | Cheng | 383/78 |
| 4,907,693 | 3/1990 | Child | 229/125.32 |
| 4,930,903 | 6/1990 | Mahoney | 383/6 |
| 4,995,557 | 2/1991 | Fremion | 229/125.32 |
| 5,014,872 | 5/1991 | Robbins, III | 383/96 |
| 5,044,773 | 9/1991 | Harms et al. | 383/22 |
| 5,165,800 | 11/1992 | Downey | 383/78 |
| 5,400,914 | 3/1995 | Lin | 229/125.12 |
| 5,441,348 | 8/1995 | Valentino | 383/127 |
| 5,516,038 | 5/1996 | Zaccarini | 229/125.12 |
| 5,608,949 | 3/1997 | Cooley et al. | 24/30.5 R |

FOREIGN PATENT DOCUMENTS

| | | | |
|---|---|---|---|
| 94 09 222 | 9/1994 | Germany . | |
| 723929 | 2/1955 | United Kingdom | 94/15 C |

*Primary Examiner*—Paul T. Sewell
*Assistant Examiner*—J. Mohandesi
*Attorney, Agent, or Firm*—Michaele A. Hakamaki

[57] ABSTRACT

A gift package a bag having generally parallel front and rear walls, each having a top edge, a bottom edge opposite the top edge, and two lateral edges, and a pair of generally parallel side walls, each having a top edge, a bottom edge opposite the top edge, and a generally longitudinal fold, wherein the lateral edges of the bottom panel are joined to the bottom edges of the front, rear, and side walls to form a container having an opening defined by the top edges of the front, rear, and side walls, and wherein the bag has an expanded state and a collapsed state, where an area of the bag opening is larger when the bag is in its expanded state than when the bag is in its collapsed state, and a bag topper comprising a body portion having a top and a bottom surface, and at least one side panel extending from the body portion, wherein the bottom surface of the body portion is supported on the top edge of at least one of the folds of the side walls.

11 Claims, 2 Drawing Sheets

GIFT PACKAGE

TECHNICAL FIELD

The present invention relates to bag closures, in particular to a reusable bag closure adapted to conceal the contents of the bag.

BACKGROUND OF THE INVENTION

In recent years, there has been a tremendous growth in the manufacture and sale of containers, particularly decorative containers for receiving and holding objects, such as gift objects. One form of such containers is a decorative bag that is adapted to receive a gift item, which eliminates the need to place the items in separate boxes that are usually subsequently wrapped with gift wrapping paper. Instead, gift items may be "wrapped" in the bag and hidden from view using such items as tissue paper, confetti, bag stuffing, shredded ribbons, and the like. However, it is difficult to securely close such decorative bags if the user wishes to completely enclose the item in the bag. Several examples of bag closing methods include using decorative twist ties, tying bag handles together (if the bag has such handles), placing a fastenable bag closure on the bag (see, for example, U.S. Pat. Nos. 5,608,949 and 5,165,800), attaching a bow mechanism, such as that shown in U.S. Pat. No. 4,867,577, and stapling or taping the bag closed.

While these closures are useful, they often disadvantageously reduce the amount of usable space within the gift bag. One suggested solution to this problem was to provide inner structural support to give the bag the appearance of a box, and to provide a rectilinear lid to close the mouth of the bag. The handles of this bag extend through the slots in the lid, such as is shown in U.S. Pat. No. 4,930,903. Another alternative means for converting a gift bag into a "gift box" is to provide for overlapping flaps that can be folded into a configuration that gives a box-like appearance, such as that shown in U.S. Pat. No. 4,836,690.

SUMMARY OF THE INVENTION

In one aspect of this invention a gift package is provided comprising a bag having generally parallel front and rear walls and two generally parallel side walls, wherein each wall has generally parallel top and bottom edges and two lateral edges, wherein the bag has an expanded state and a collapsed state, where an area of the bag opening is larger when the bag is in its expanded state than when the bag is in its collapsed state, and a bag topper comprising a body portion having a top and a bottom surface, and at least one side panel extending from the body portion. The bag further comprises at least one central longitudinal crease or fold in at least one of the two side panels and may also comprise at least two diagonal creases or folds at the bottom edges of the two side panels. The bottom surface of the body portion is supported on the top edge of at least one of the folds of the side walls.

Optionally, the bag topper can be decorated with various configurations of gift ribbons, cut-out figures, balloons, and other decorative items. These items can be used to "address" the gift bag to the recipient, provide a greeting, identify the occasion for the gift bag, provide for visually stimulating decorations, and the like. Advantageously, the gift bags, particularly the bag topper provided by this invention, allow the user to utilize the full interior of the bag while being able to securely close the bag.

The preformed gift bag topper of the present invention is convenient, simple to use, and minimizes the time required to decorate a gift bag. Furthermore, the preformed gift bag topper eliminates the potential frustration of forming tissue or other fillers into a pleasing decorative shape. The present invention allows all users, whether creatively inclined or not, to quickly and attractively "wrap" a gift. Additionally, the article of the present invention is configured in such a manner so that it may easily incorporate a wide variety of decorations.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
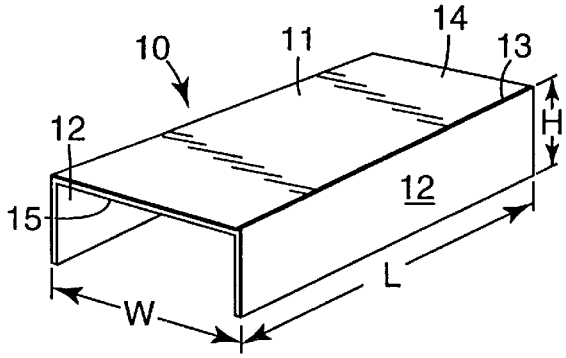
FIG. 1 is an isometric view of a closing mechanism of the present invention.
Figure 3:
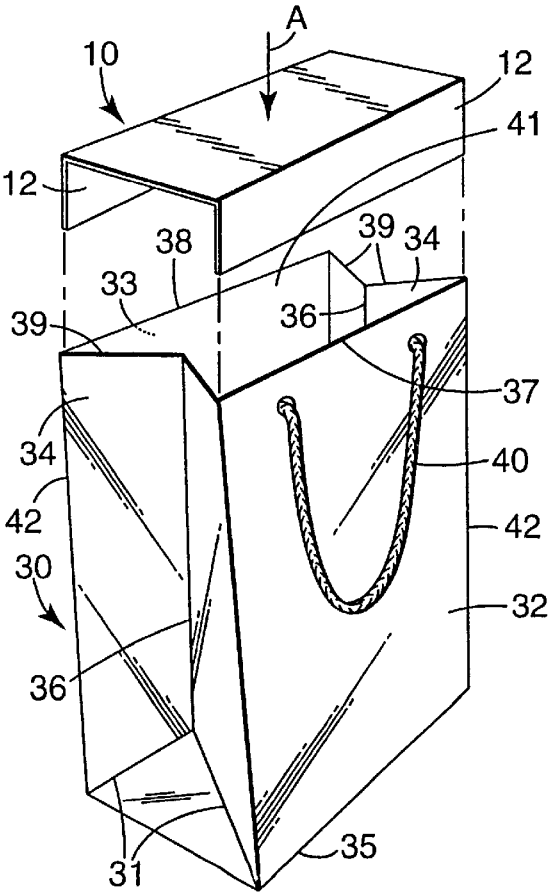
FIG. 3 is an isometric view of the gift bag and closing mechanism of FIG. 1.
Figure 4:
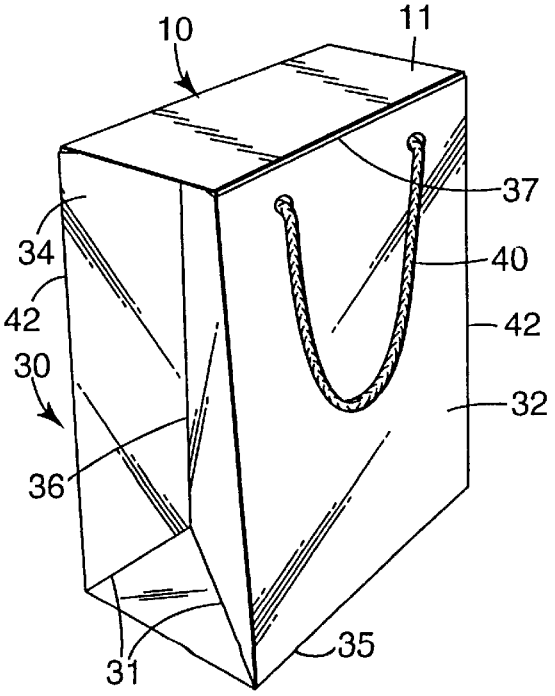
FIG. 4 is an isometric view of the gift bag and closing mechanism of FIG. 3, wherein the bag is closed.

Referring now to the Figures, wherein the components are labeled with like numerals throughout the several Figures, and initially to FIGS. 1, 3, and 4, one preferred embodiment of the gift package of the present invention is shown, generally comprising a bag 30 and a bag topper 10. The bag 30 is preferably fabricated from decorated paper, cardstock, or polymeric film, any of which may be coated or uncoated. The material is generally flexible, but possesses a degree of stiffness that is sufficient to provide a free-standing, upright bag. The bag 30 is conventional in design, including four longitudinal folds 42 dividing the bag 30 into generally parallel front and back walls or panels 32, 33 and two generally parallel side walls or panels 34. The parallel front and back panels 32, 33 each have an upper edge 37, 38, respectively. The bottom of the bag is folded in such a way as to provide for a flat bottom 35, which is preferably rectilinear in shape. The bag 30 as illustrated is in an open position providing an opening 41 through which access is gained to the interior of the bag 30. The side panels 34 each have a central longitudinal crease or fold 36 and a pair of diagonal folds 31 extending from the crease or fold 36. The side panels each also have an upper edge 39, which extends between the upper edges 37, 38 of the front and back panels 32, 33. Further, the upper edges 37, 38, 39 of the bag are generally fabricated so that the edges 37, 38, 39 have a double material thickness.

The bag 30 is preferably further provided with a pair of handles 40, where one handle is connected to front panel 32 and the other handle 40 is connected to the back panel 33. The handles 40 may be of any suitable type and as illustrated may be a relatively flexible material, such as a ribbon, cording, or the like. The handles 40 may be attached and secured to the bag in any suitable fashion. Although the handles 40 are illustrated as lying on the outside surface of the front panel 32, the handles 40 may also be attached and secured to the front and back panels 32, 33 in such a manner as to allow the handles 40 to lie on the surface of the front and back panels 32, 33 on the inside of the bag 30. Alternatively, the handles may be relatively rigid and extend generally upwardly from the upper edge 37, 38 of the front and back panels 32, 33.

Bag 30 is shown in the Figures in a partially opened or expanded condition, where the creases are partially folded toward the inside of the bag. When the bag is in its fully opened or expanded state, the creases are not folded toward the inside of the bag (i.e., the side panels 34 are flat). In this opened condition, items may easily be placed and stored in the bag. However, when the bag is not in use, it may be folded along the longitudinal creases or folds 36 and diagonal folds 31 toward the center of the bag to collapse the bag into a collapsed or compact state. In this way, multiple bags may more easily be stored or shipped in a stack.

Bag topper 10 preferably comprises a base 11 having a top surface 14 and an opposite bottom surface 15, and at least two side panels 12 extending from the base 11. The panels 12 are generally parallel to each other and folded along a fold line 13 to be perpendicular to the base 11. The base 11 also has a length L, a width W, and a height H, wherein a bag topper is typically designed to fit into a particular sized bag based on both the dimensions of the bag topper and the dimensions of the bag opening. More particularly, the length L should be no larger than the longest opening of the gift bag, and is preferably approximately equal to the longest opening of the bag. For example, in the embodiment of FIG. 3, the length L is approximately equal to the length of the upper edge of either the front panel 32 or the back panel 33. The width W of the top panel is typically smaller than the width of the upper edge 39 of the side panels 34 in its expanded state, where the width W may be selected based on the desired effect for the finished gift bag, as explained in further detail below.

To use bag topper 10 with a bag 30, the bag topper 10 is moved in a downward direction (represented by arrow A) until the side panels 12 are at least partially inserted into the opening 41 of the bag. Preferably, the side panels 12 are generally parallel to the front and back panels 32, 33 of the bag 30. The bag topper 10 is further moved downward in the direction of arrow A, preferably until the bottom surface 15 of the base 11 is resting on the upper edges 39 of the side panels 34, and particularly on the creases 36 of the bag 30, as shown in FIG. 4. Thus, when the width W of the base 11 is significantly smaller than the width of the upper edge 39 of the side panels 34 in their expanded state, the front and rear panels 32, 33 are drawn toward each other, and the crease 36 becomes increasingly defined or larger as the crease folds toward the inside of the bag. In fact, the width W of the base 11 may be so small that the upper edges 37, 38 of the front and rear panels 32, 33 will be touching or only slightly separated when positioned in a bag, thereby forming the bag into a nearly triangular shape. However, when the width W of the base 11 is only slightly smaller than the width of the upper edge 39 of the side panels 34, the front and rear panels 32, 33 are drawn toward each other by a lesser distance than when the width W of the base is significantly smaller. Consequently, the crease 36 may be relatively slight, so that the bottom surface 15 of base 11 has only a small crease 36 on which to rest. In any case, when the bag topper 10 is inserted into the bag 30 so that the bottom surface 15 of the base 11 is resting on the creases 36, the bag 30 is considered closed. However, the bag 30 may also be considered to be closed even if the bottom surface 15 of the base 11 is not resting on the creases 36, as long as the side panels 12 are at least partially inserted into the bag opening 41.

Alternatively, at least a portion of at least one of the side panels 12 may be configured with an attaching means that facilitates connection to the inside surface of a bag 30. For example, the attaching means could be in the form of a patterned adhesive, a strip of adhesive, such as transfer adhesive, hook and loop material, and the like. The attaching means can provide for permanent or reusable adhesion to the gift bag.

While the bag topper of the present invention preferably includes two side panels 12, where one side panel 12 is adjacent to one of the front and rear walls 32, 33 of the bag 30, and the other side panel 12 is adjacent to the other of the front and rear walls 32, 33, the bag topper may instead include more or less than two side panels 12. For one example, the bag topper may have one panel 12 adjacent to the front wall 32, another panel 12 adjacent to the rear wall 33, and another panel 12 adjacent to one of the side walls 34.

As described above, the bag topper 10 is typically supported on the upper edges 39 of the side walls 34. However, the bag topper 10 may instead be rotated 90 degrees so that the bag topper is supported by the front and back panels 32, 33, such as with an additional attaching means, such as that described above.

Figure 2:
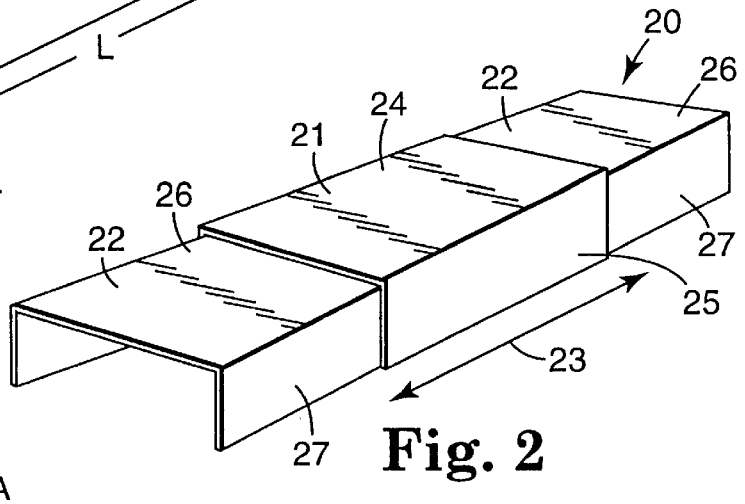
FIG. 2 is an isometric view of an alternative closing mechanism of the present invention.

Referring now to FIG. 2, an alternative embodiment of the bag topper of the present invention is illustrated as an adjustable bag topper 20. Bag topper 20 comprises a first portion 21 and at least one adjustable end piece 22 that has generally the same configuration as the first portion 21 so that it may slide in a direction 23 to adjust the length of the bag topper 20. As shown in the Figure, the first portion 21 comprises a base 24 and at least one side panel 25 extending from base 24. Further, each of the adjustable end pieces 22 also has a base 26 and at least one side panel 27 extending therefrom. The panels 25, 27 are generally parallel to each other and generally perpendicular to the bases 24 and 26. The bag topper 20 thus has an adjustable length, a fixed width, and a fixed height, wherein a bag topper is typically selected to fit into a particular bag based on both the dimensions of the bag topper and the dimensions of the bag opening. The length is adjustable by sliding the adjustable end piece or pieces 22 toward or away from the first portion 21 to allow a single bag topper 20 to be appropriate for use with bags having various lengths within a particular range.

Figure 5:
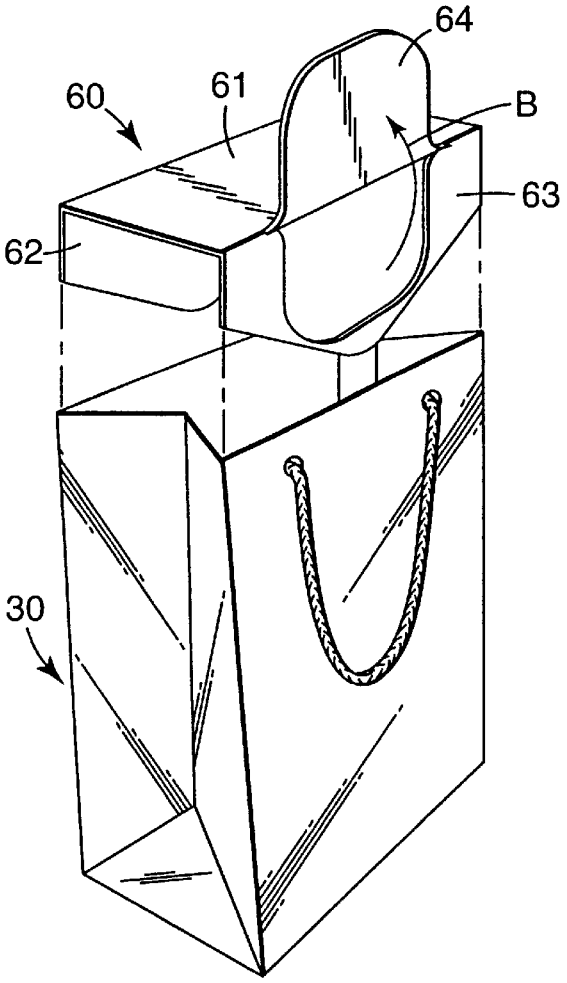
FIG. 5 is an isometric view of an alternative embodiment of the closing mechanism of the present invention having a cut-out portion.
Figure 6:
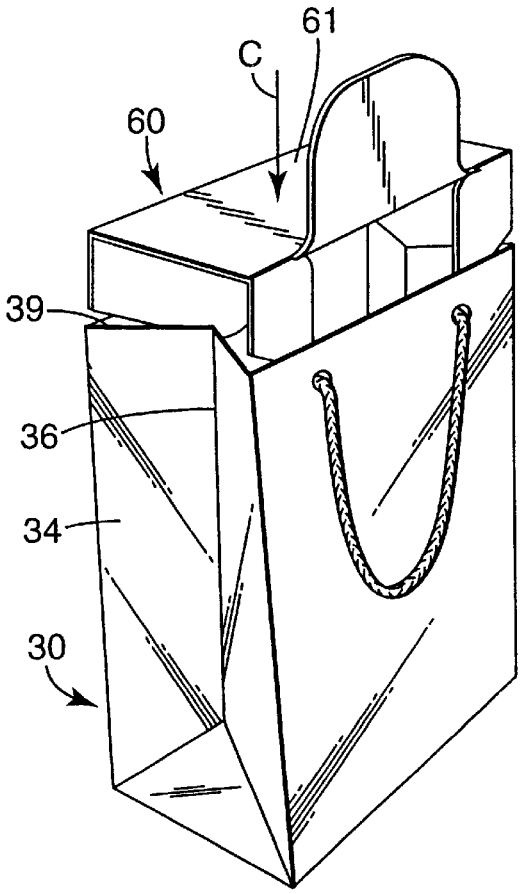
FIG. 6 is an isometric view of the closing mechanism of FIG. 5, wherein the closing mechanism is partially inserted into a bag.

Referring now to FIGS. 5 and 6, an alternative embodiment of a bag topper 60 is illustrated. In this embodiment, the bag topper 60 has a base 61 and two side panels 62, 63. At least one of the two side panels 62, 63 has a cut-out portion 64 that may extend in a generally upward direction from the base 61. This cut-out portion 64 may be decorative, containing a display or being used to display indicia, for example. Before the bag topper is placed in a bag 30, the cut-out portion 64 is preferably rotated in the direction of arrow B until the portion 64 is generally perpendicular to the base 61. However, the portion 64 needs only to be rotated far enough in the direction of arrow B so that the portion 64 will be visible after the bag topper is inserted into the bag. The bag topper 60 is inserted into a bag 30 in a similar manner to that described above, where the topper 60 is moved in the direction of an arrow C into the opening of the bag. Preferably, the topper 60 is moved into the bag until the bottom surface of the base 61 is resting on the upper edges 39 of the side panels 34, and particularly on the creases 36 of the bag 30.

While the figures and above discussion represent various configurations, these illustrations are not meant to limit the various configurations of the bag topper of the present invention. Furthermore, any of the configurations could have additional elements and such additional elements may be used on the various configurations illustrated herein. For example, the bag topper could be configured with an adhering means that facilitates adherence to the inside surface of a gift bag. This adhering means could be in the form of a patterned adhesive layer, a strip of adhesive, such as transfer adhesive, hook and loop fasteners, and the like. The adhering means can provide for permanent or repositionable adhesion to the gift bag. In addition, any of the bag toppers of the invention may have decorative elements attached thereto, which may include any of a number of visually appealing two or three-dimensional elements, such as fringes, ribbons, balloons, or the like.

In accordance with the present invention, it is desirable that the material used to construct the bag topper is sufficiently rigid so that the topper retains its shape when supported on the top edges of the bag. However, it is also desirable that the bag topper be relatively lightweight so that it does not cause the sides of the bags to collapse when the topper is placed on the top edges of the bag.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein but only by the structures described by the language of the claims and the equivalence of those structures.

What is claimed is:

1. A gift package comprising:

a bag comprising;

generally parallel front and rear walls, each having a top edge, a bottom edge opposite the top edge, and two lateral edges;

a bottom panel having a plurality of lateral edges; and a pair of generally parallel side walls, each having a top edge, a bottom edge opposite the top edge, and a generally longitudinal fold having a first end adjacent to the top edge of the side wall and a second end spaced from the first end, wherein the lateral edges of the bottom panel are joined to the bottom edges of the front, rear, and side walls to form a container having an opening defined by the top edges of the front, rear, and side walls, wherein the opening has a width, and wherein the bag has an expanded state and a collapsed state, where the width of the bag opening is larger when the bag is in its expanded state than when the bag is in its collapsed state; and a bag topper comprising a body portion having a top surface, a bottom surface, a front edge, a back edge, side edges extending between the front and back edges, a width between the front and back edges, and at least one side panel extending from at least one of the front and back edges of the body portion, wherein the width of the body portion is less than the width of the bag opening when the bag is in the expanded state, and wherein the at least one side panel is at least partially inserted into the opening of the bag adjacent at least one of the front and rear walls.

2. The gift package of claim 1, wherein each of the pair of side walls further comprises at least two diagonal folds, each fold extending from the bottom edge of the side wall toward the second end of the longitudinal fold.

3. The gift package of claim 1, wherein the top edge of each of the front, rear, and side walls further comprises a length, wherein the body portion further comprises a length in the direction of the at least one side panel and a width that is generally perpendicular to the length, and wherein the width of the body portion is smaller than the length of the side walls when the side walls are in the expanded state, so that the bag topper compresses the fold of at least one of the side walls of the bag.

4. The gift package of claim 1, wherein the bag topper has an adjustable length.

5. The gift package of claim 1, wherein the bag topper further comprises at least one decorative element extending therefrom.

6. The gift package of claim 1, wherein at least one of the side panels has a cut-out portion that extends in a generally upward direction from the body portion.

7. The gift package of claim 1, wherein the bag topper is made of material that is at least as rigid as the bag material.

8. The gift package of claim 1, wherein each of the front, rear, and side walls of the bag further comprise an inside surface and an outside surface, and wherein the bag topper further comprises an adhering means to facilitate adherence of the bag topper to the inside surface of at least one of the front, rear, and side walls of the bag.

9. The gift package of claim 8, wherein the adhering means comprises a permanent adhesive.

10. The gift package of claim 8, wherein the adhering means comprises a repositionable adhesive.

11. A bag topper decorating a bag of the type comprising generally parallel front and rear walls, each having a top edge, a bottom edge opposite the top edge, and two lateral edges, a bottom panel having a plurality of lateral edges, and a pair of generally parallel side walls, each having a top edge, a bottom edge opposite the top edge, and a generally longitudinal fold having a first end adjacent to the top edge of the side wall and a second end spaced from the first end, wherein the lateral edges of the bottom panel are joined to the bottom edges of the front, rear, and side walls to form a container having an opening defined by the top edges of the front, rear, and side walls, wherein the opening has a width, and wherein the bag has an expanded state and a collapsed state, where the width of the bag opening is larger when the bag is in its expanded state than when the bag is in its collapsed state, wherein the bag topper comprises:

a body portion having a top surface, a bottom surface, a front edge, a back edge, side edges extending between the front and back edges, a width between the front and back edges, and at least one side panel extending from at least one of the front and back edges of the body portion, wherein the width of the body portion is adapted to be less than the width of the bag opening when the bag is in the expanded state, and wherein the at least one side panel is adapted to be at least partially inserted into the opening of the bag adjacent at least one of the front and rear walls.

* * * * *